US010640946B2

(12) United States Patent
Cornillie et al.

(10) Patent No.: US 10,640,946 B2
(45) Date of Patent: May 5, 2020

(54) TIP FOR A FOUNDATION PILE

(71) Applicant: PROFERRO NV, Ypres (BE)

(72) Inventors: Christian Cornillie, Voormezele (BE); Rik Descamps, Langemark (BE); Nicolas Couckuyt, Geluwe (BE)

(73) Assignee: Proferro NV, Ypres (BE)

( * ) Notice: Subject to any disclaimer, the term of this patent is extended or adjusted under 35 U.S.C. 154(b) by 0 days.

(21) Appl. No.: 16/084,361

(22) PCT Filed: Mar. 1, 2017

(86) PCT No.: PCT/IB2017/051194
§ 371 (c)(1),
(2) Date: Sep. 12, 2018

(87) PCT Pub. No.: WO2017/158460
PCT Pub. Date: Sep. 21, 2017

(65) Prior Publication Data

US 2019/0071835 A1 Mar. 7, 2019

(30) Foreign Application Priority Data

Mar. 15, 2016 (BE) ..... 2016/5190

(51) Int. Cl.
*E02D 5/56* (2006.01)
*E02D 5/72* (2006.01)

(52) U.S. Cl.
CPC ..... *E02D 5/72* (2013.01); *E02D 5/56* (2013.01); *E02D 2300/0031* (2013.01); *E02D 2600/20* (2013.01); *E02D 2600/30* (2013.01)

(58) Field of Classification Search
CPC ..... E02D 5/72; E02D 5/56; E02D 1200/0031; E02D 2600/20; E02D 2600/30
See application file for complete search history.

(56) References Cited

U.S. PATENT DOCUMENTS 722,417 A * 3/1903 Villet ..... E02D 5/36 405/239
790,910 A * 5/1905 McClintock ..... E02D 7/30 111/7.1
1,352,128 A * 9/1920 Howell ..... E02D 5/34 173/137
2,391,828 A * 12/1945 Hood ..... E02D 5/665 175/293

(Continued)

FOREIGN PATENT DOCUMENTS

EP 0855489 A2 7/1998
FI 85901 B 2/1992
WO 2011075772 A1 6/2011

OTHER PUBLICATIONS

Belgian Search Report from BE Application No. BE 201605190, dated Jul. 18, 2016.

(Continued)

*Primary Examiner* — Benjamin F Fiorello
(74) *Attorney, Agent, or Firm* — Workman Nydegger

(57) ABSTRACT

A tip is described for attachment to a bottom end of a foundation pile. The tip comprises a cast iron tip body and an element partially molded into the cast iron tip body. A foundation pile assembly comprises such a tip. A method for manufacturing is provided for such a tip.

20 Claims, 4 Drawing Sheets

(56) References Cited

U.S. PATENT DOCUMENTS

| | | | | |
|---|---|---|---|---|
| 2,961,839 | A * | 11/1960 | Aresti | E02D 27/32 405/231 |
| 3,131,543 | A * | 5/1964 | Dougherty | E02D 5/52 405/251 |
| 3,306,054 | A * | 2/1967 | Dougherty | E02D 5/72 405/253 |
| 4,623,025 | A | 11/1986 | Verstraeten | |
| 6,082,472 | A | 7/2000 | Verstraeten | |
| 7,984,552 | B2 * | 7/2011 | Doud | B60B 35/003 29/525.01 |
| 2015/0023739 | A1 * | 1/2015 | Coulon | E02D 5/72 405/233 |
| 2016/0031005 | A1 * | 2/2016 | Melekian | B22D 19/16 164/76.1 |

OTHER PUBLICATIONS

International Search Report from PCT Application No. PCT/IB2017/051194, dated May 11, 2017.

* cited by examiner

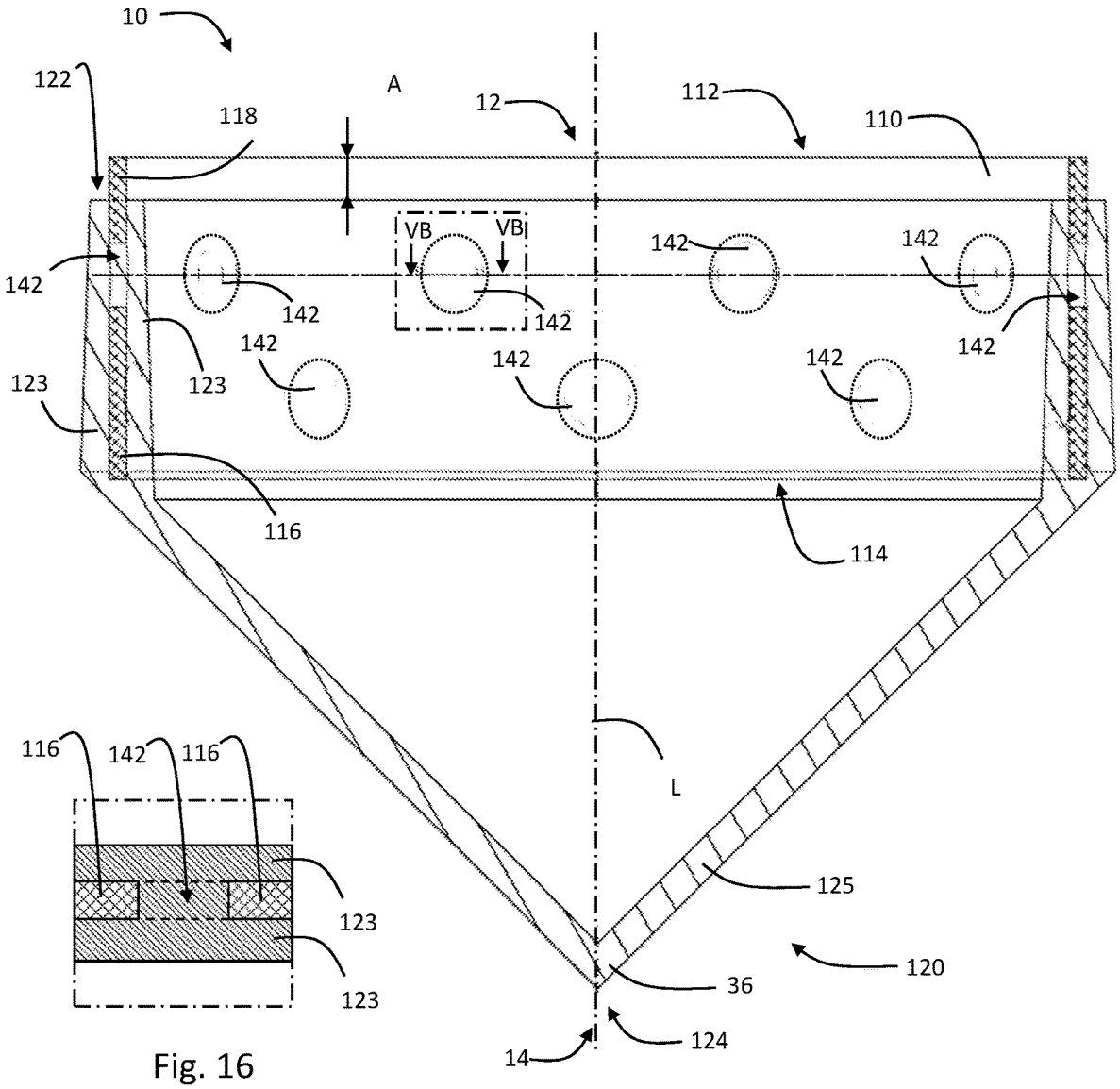
Fig. 16
Fig. 5
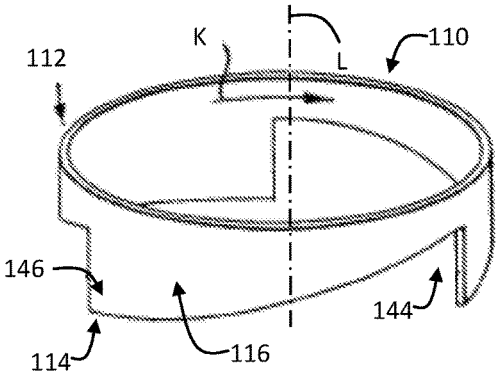
Fig. 6
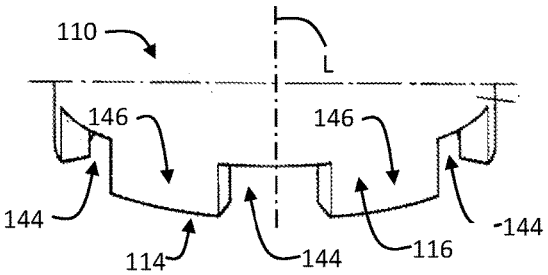
Fig. 7

TIP FOR A FOUNDATION PILE

BACKGROUND

The invention relates to a tip, more in particular to a tip for attachment to a bottom end of a foundation pile. The invention also relates to a method for manufacturing such a tip, as well as a foundation pile assembly that makes use of such a tip.

A tip for an on-site formed foundation pile assembly is, for example, known from U.S. Pat. No. 4,623,025 and EP0855489. Such a tip is also called drill tip, and is attached to the bottom end of a foundation pile. The tip is preferably designed as a cast iron structure since this facilitates the production of a suitable shape, in particular of, for example, spiral ribs which are arranged to the surface of the tip. In order to couple the tip to the bottom end of the foundation pile, the tip is provided with cam-shaped structures that couple into corresponding recesses at the bottom end of the foundation pile. This offers the advantage that the foundation pile can be removed again after the formation of an on-site poured concrete foundation pile, such that only the tip and the concrete foundation pile remain behind in the ground layer. However, for certain applications, for example, wherein the foundation pile assembly is used in an environment with a water layer, a swampy area, etcetera there is the need to make use of a tip that is fixedly coupled to the foundation pile assembly to avoid inflow of water into the foundation pile assembly during entering into the ground layer and during the formation of an on-site formed concrete foundation pile. In addition, there is also the desire to achieve an improved anchoring of the tip to the bottom end of the foundation pile in an effort to be able to withstand higher pressure forces and torques upon entering of the foundation pile assembly in the ground layer.

Furthermore, it is not easy to achieve a welded joint between a cast iron tip and a steel foundation pile at a construction site where a foundation pile assembly should be assembled on the basis of delivered foundation piles and tips as this requires welding operations and associated equipment which are normally not at disposal at a construction site.

A tip for a foundation pile is further known from FI85901B. This foundation pile assembly comprises a tip for the bottom end of a pre-manufactured concrete foundation pile, in which a tip element is attached at the bottom end of the tip. Such a type of tip makes it possible, in particular in circumstances in which the support surface is rocky, to distribute the tension at the height of the bottom end of the foundation pile as uniform as possible in order to avoid uneven peak loads as much as possible. However, the manufacture of such a tip requires a plurality of welding operations for the manufacture of the tip body. It is also necessary for the arrangement of the tip element to the tip body that sufficient clearance and an associated attachment element such as, for example, a bolt are provided. This clearance and associated tolerances ensure that at high loads the anchoring of the tip element is not optimal and therefore unwanted peak loads can still arise. Moreover, it requires additional manual or mechanical operations in order to be able to attach the tip element.

Furthermore, a tip is also known from WO2011/075772, wherein in an exemplary embodiment is described that, in order to allow the welding of a tip to a foundation pile, it is desirable to manufacture the tip from cast steel. However, cast steel is a much more expensive material than cast iron.

Such a cast steel tip is also more difficult to manufacture since the molding process, for example, requires higher melting temperatures.

SUMMARY

In the context of this application, the term cast steel shall mean a cast alloy of iron comprising a mass percentage of carbon of less than 2.1% (m/m), this means a mass fraction of carbon of less than 0.021 kg/kg. Cast iron is, in the context of this application, a cast alloy of iron comprising a mass percentage of carbon of more than 2.2% (m/m), this means a mass fraction of carbon of more than 0.022 kg/kg, for example, a mass fraction of 0.030 kg/kg or more, in particular a mass fraction of 0.035 kg/kg or more. Depending on the type of cast iron, one may speak of a carbon content or carbon equivalent. For example, with nodular cast iron, for example, one speaks of a carbon content of 0.035 kg/kg. For example, with lamellar cast iron, for example, one speaks of a carbon equivalent between 3.53% and 3.8%.

Consequently, there exists a need for a tip which is simple to manufacture and which enables a foundation pile assembly with a simplified and improved anchoring.

For this purpose, according to a first aspect of the invention, a tip is provided for attachment to a bottom end of a foundation pile, wherein the tip comprises a cast iron tip body, characterized in that the tip further comprises an element partially molded-in into the cast iron tip body.

The partially molded-in element is directly enveloped with and adheres very closely to the cast iron of the cast iron tip body, which realizes a simplified and improved anchoring. Furthermore, in this way a tip is realized that can be manufactured by means of a simple molding process.

According to an embodiment, a tip is provided, characterized in that:

- the tip extends axially from a top attachment side for the attachment of the foundation pile to an opposite bottom tip side along a central longitudinal axis;
- the cast iron tip body also extends axially along the central longitudinal axis of the tip, from a top end to a bottom end; and
- the element partially molded-in into the cast iron tip body also extends axially along the central longitudinal axis of the tip, from an external end toward a molded-in end.

In this manner, the tip can withstand high loads and torques in an efficient manner, for example, upon entering of the foundation pile assembly into the ground layer.

According to a further embodiment, a tip is provided, characterized in that the element partially molded-in into the cast iron tip body:

- comprises a molded-in part which extends into the cast iron tip body and is enveloped by the cast iron of the cast iron tip body; and
- comprises an external part which extends outside the cast iron tip body.

In this manner an improved anchoring between the molded-in element and the tip body is enabled in a simple manner.

According to a further embodiment, a tip is provided, characterized in that the element partially molded-in into the cast iron tip body consists of a material having a higher melting point than the cast iron of the cast iron tip body.

In this manner, the partially molded-in element, which is manufactured, for example, from steel or another suitable metal alloy, can be arranged without risk of undesirable deformation at the tip.

According to a further embodiment, a tip is provided, characterized in that the molded-in part:

comprises one or more openings, recesses and/or protrusions which at least partially extend radially; and/or comprises one or more openings, recesses and/or protrusions which at least partially extend axially, eccentrically with respect to the central longitudinal axis.

In this manner an improved anchoring is realized which allows to withstand high loads and/or torques, for example, upon entering of the foundation pile into the ground layer.

According to a further embodiment, a tip is provided, wherein the tip is configured for attachment to a steel foundation pile by means of a welded joint, characterized in that the element partially molded-in into the cast iron tip body is a steel attachment element which is arranged at the attachment side of the tip.

In this manner, a good sealed connection between the tip and the foundation pile can be realized in a simple and efficient manner at a construction site, without the need for complex welding operations and associated devices.

According to a further embodiment a tip is provided, characterized in that the steel attachment element is tubular.

This is advantageous since such a steel tubular shape is easily connectable to the steel tubular shape of a foundation pile.

According to a further embodiment a tip is provided, characterized in that the cast iron tip body:

comprises a cylindrical part at the top end, wherein the molded-in part of the tubular steel attachment element is molded-in; and/or comprises a cone-shaped part, of which the point is located at the bottom end.

Such a design allows to easily mold a tubular attachment element at the top end, and in order to achieve an efficient penetration of the ground layer to the bottom end.

According to a further embodiment, a tip is provided, characterized in that the cast iron tip body comprises one or more spiral ribs.

This ensures an efficient penetration of the ground layer during entering of the foundation pile assembly by means of a screw movement.

According to further embodiment, a tip is provided, characterized in that the element partially molded-in into the cast iron tip body, is arranged at the tip side of the tip as a tip element for the foundation pile.

In this manner, such a type of foundation pile assembly is realized in a simple manner with an optimum anchoring and distribution of the tensions since the tip element is directly enveloped by the cast iron of the tip body.

According to a second aspect of the invention, a foundation pile assembly is provided, comprising a tip according to the first aspect of the invention, characterized in that the foundation pile assembly further comprises a foundation pile, and wherein the tip is attached to a bottom end of the foundation pile.

The partially molded-in element is enveloped directly with and fits very closely on the cast iron of the cast iron tip body, such that a simplified and improved anchoring is realized, wherein, for example during entering of the foundation pile assembly, higher loads and torques can be withstood.

According to a further embodiment, a foundation pile assembly is provided, characterized in that, at the height of the bottom end, the transverse cross-section of the foundation pile at least partially connects to or corresponds to the cross-section of the tip.

This allows to connect the foundation pile with the tip in a simple manner, for example, by means of a welded joint.

According to a further embodiment, a foundation pile assembly is provided, characterized in that the tip is attached to the steel foundation pile by means of a welded joint.

Particularly, when the tip comprises a steel attachment element at its top end, then it becomes possible to arrange the tip at the bottom end of a steel foundation pile in a simple manner by means of a welded joint with simple equipment that is present at the construction site.

According to a third aspect of the invention, a method for manufacturing a tip according to the first aspect of the invention is provided, characterized in that the method comprises the following steps:

providing a mold for the cast iron tip body comprising a recess corresponding to the external part of the partially molded-in element, arranging the external part of the partially molded-in element in the recess of the mold, so that the molded-in part extends into the mold for the cast iron tip body; and subsequently, molding liquid cast iron into the mold for the cast iron tip body, so that the molded-in part of the element is molded-in.

This allows to manufacture the tip by means of a simple molding process and the recess thereby ensures that the partially molded-in element is positioned in a correct manner with respect to the tip body.

According to a further embodiment, a method for manufacturing a tip is provided, characterized in that the method comprises the following steps:

providing a lower sand mold for the mold, the lower sand mold comprising the recess;

subsequently arranging the external part of the element in the recess;

subsequently completing the mold by providing an upper sand mold; and subsequently molding liquid cast iron into the mold, so that the molded-in part of the element is molded-in.

The use of a lower sand mold and upper sand mold facilitates the arrangement of the external part of the element in the recess.

According to a fourth aspect of the invention, a method for manufacturing a foundation pile assembly according to the second aspect of the invention is provided, wherein the tip is arranged by means of a molded-in steel attachment element partially molded-in into the cast iron tip body, to the bottom end of the steel foundation pile by means of a welded joint.

In this manner, the tip can be arranged in a simple manner, at the construction site, by means of a welded joint to the bottom end of the foundation pile, without the need for complex welding equipment.

BRIEF DESCRIPTION OF THE DRAWINGS

The invention will hereinafter be further described with reference to embodiments shown in the drawings, wherein:

FIG. 5 schematically shows a sectional view of the embodiment of the tip of FIG. 4, along the line V-V in FIG. 4;

FIGS. 6 and 7 schematically show alternative embodiments of an attachment element for the tip;

FIG. 16 shows a sectional view of a fragment of FIG. 5 along the line VB-VB.

DETAILED DESCRIPTION OF VARIOUS EMBODIMENTS

Figure 1:
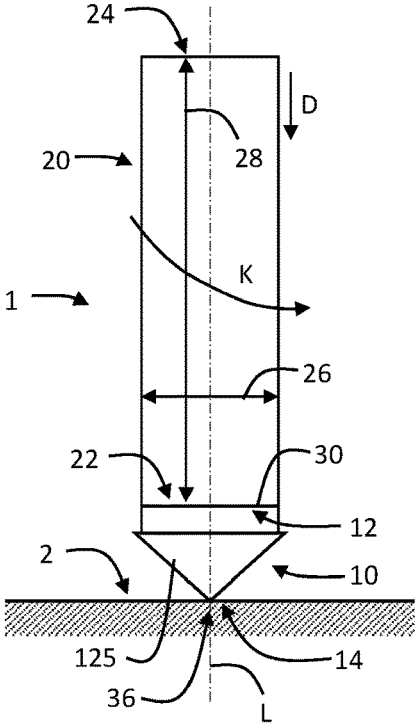
FIG. 1 schematically shows an embodiment of a foundation pile assembly according to the invention in a state before entering into a ground layer.

FIG. 1 shows an embodiment of a foundation pile assembly 1 according to the invention. In the state shown, the foundation pile assembly 1 extends axially, this means along a central longitudinal axis L, according to a substantially vertical direction and substantially transverse with respect to the ground layer 2. When, in the following description, terms such as top, bottom, . . . or similar expressions are used, then this refers to the illustrated orientation of the foundation pile assembly 1. It goes without saying that alternative embodiments and/or alternative orientations are possible, for example, wherein the foundation pile assembly is entered under a given angle with respect to the vertical direction and/or not transverse with respect to the ground layer. In such alternative embodiments this terminology should be interpreted in the light of a similar positioning or orientation of the elements of the foundation pile assembly 1 according to the axial direction, this means along the direction of the central longitudinal axis L.

As shown in FIG. 1, this embodiment of the foundation pile assembly 1 comprises a steel foundation pile 20. The steel foundation pile 20 is an elongated, tubular body, for example, a cylindrical steel tube. As shown, the steel foundation pile 20 extends axially along a central longitudinal axis L between a bottom end 22 and an opposite top end 24. As is further shown, the diameter 26 of the steel foundation pile 20 is less than the length 28 of the foundation pile 20. The diameter 26 of the foundation pile 20 is typically in the order of magnitude of 10 cm to 50 cm, but may also range up to, for example, 2 m or 3 m. The wall thickness of the steel foundation pile is typically in the range of 1 mm to 10 mm, but may, for example, range up to 25 mm or more, and is therefore typically less than 5% of the diameter 26 to allow for a sufficiently large central opening in the foundation pile 20 to allow for the feeding of construction material such as concrete. The length 28 of a foundation pile 20 is often in the range of 5 m to 35 m, but may range up to, for example, 50 m or more. In any case, the length 28 of the foundation pile 20 is typically a plurality of its diameter 26.

As shown in FIG. 1, the foundation pile assembly 1 further comprises a tip 10 which may act as a drill tip. The tip 10 is attached to the bottom end 22 of the steel foundation pile 20. As can be seen, the tip 10 extends axially, this means along the direction of the central longitudinal axis L, from an attachment side 12 to an opposite tip side 14. As shown, the tip 10 at the attachment side 12 is connected to the foundation pile 20. The opposite tip side 14 is therefore directed away from the foundation pile 20 and in this way forms the bottom end of the foundation pile assembly 1. As will be further clarified, during entering of the foundation pile assembly 1, the tip 10 will be first entered into the ground layer, after which the foundation pile 20 follows. In addition, the foundation pile assembly 1 is entered axially, this means substantially along the direction of the central longitudinal axis L in the ground layer 2. It is clear that furthermore the tip 10 first penetrates the ground layer 2 at its tip side 14, followed by its to the attachment side 12 of the foundation pile 20 connected attachment side 12, and subsequently the foundation pile 20.

Preferably, the foundation pile assembly 1 is entered into the ground layer by means of a suitable apparatus. Such an apparatus is known, for example, as a foundation machine, such as, for example, the model IHC Fundex F3500 manufactured by the firm IHC FUNDEX Equipment B.V. Such a foundation machine puts the foundation pile assembly 1 into the ground layer 2, for example, by means of a screw movement. Thereby, as shown in FIG. 1, a torque K, around the central longitudinal axis L, and a pressure force D, along the direction of the central longitudinal axis L, are exerted onto the foundation pile assembly 1. The torque K can thereby range up to, for example, 500 kNm and the downward pressure force D can thereby range up to, for example, 50 tons or 500 kN. As known by a person skilled in the art, and further shown in more detail, the tip 10 comprises, for an efficient penetration of the ground layer by means of a screw movement, preferably a cone-shaped part 125 of which the point 36 is located at the tip side 14, and/or one or more spiral screw elements. Here the tip 10 serves as drill tip. It goes without saying that according to alternative embodiments, the foundation pile assembly 1, can be entered, for example, only by means of a rectilinear axial movement, along the direction of the central longitudinal axis L, into the ground layer 2. For example, by exerting a continuous or intermittent pressure force D along the central longitudinal axis L, for example, by means of a foundation machine that is equipped with a falling weight to hammer a foundation pile assembly 1 into the ground layer 2.

With to the embodiment of the foundation pile assembly 1 shown in FIG. 1, the tip 10 at the attachment side 12 is arranged to the bottom end 22 of the steel foundation pile 20 by means of a welded joint 30. Such a welded joint 30 allows this connection to cope with the torque K and/or the pressure force D. Such a welded joint is, for example, advantageous in situations wherein the connection between the steel foundation pile 20 and the tip 10 must be sufficiently sealed, for example, to avoid ingress of moisture into the foundation pile assembly 1. This is particularly applicable when the foundation pile assembly 1 is at least partially arranged in for example, a marshy ground layer, swamp layer, water layer, etcetera.

Figure 2:
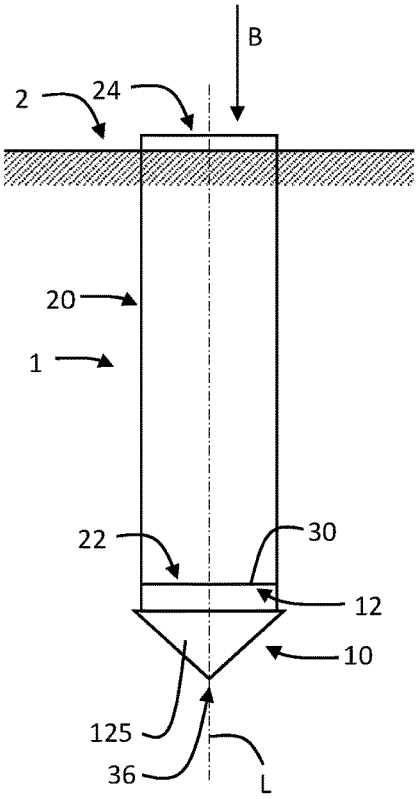
FIG. 2 schematically shows the embodiment of FIG. 1 in a state after the foundation pile assembly was entered into the ground layer.

After entering the foundation pile assembly 1 to a suitable depth in the ground layer 2, for example, the state as shown in the exemplary embodiment of FIG. 2, is reached. According to an exemplary embodiment hereinafter, for example, reinforcing elements, fresh concrete, etcetera or other suitable filler materials are entered at the top end 24 of the steel foundation pile 20, as shown by arrow B. The foundation pile assembly 1, this means the tip 10 and the steel foundation pile 20, will then continue to be present along with the on-site formed concrete pile in the ground layer 2. It goes without saying that many variant embodiments are possible, such as, for example, embodiments wherein the foundation pile assembly 1, comprises a steel foundation pile 20, which is formed by a plurality of steel foundation pile segments which each are welded together at the opposite ends. These foundation pile segments can then upon entering into the ground layer 2, for example, one by one be connected with their bottom end to the top end of a foundation pile segment already entered, to subsequently reach step by step the desired depth. The foundation pile segments can thereby, for example, also be connected by means of a welded joint or any other suitable connection such as a screw connection, a connection with a coupling piece, etcetera. It is clear that the tip 10 will thereby be arranged at the bottom end 22 of the first or bottom steel foundation pile segment of foundation pile 20, for example, by means of a welded joint 30.

Figure 3:
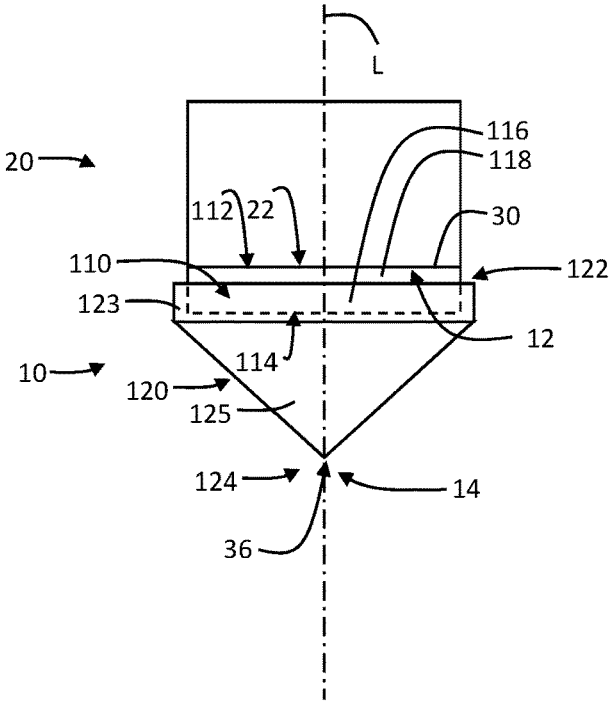
FIG. 3 schematically shows a fragment of the embodiment of the foundation pile assembly 1 of FIGS. 1 and 2 at the height of the tip in more detail.

FIG. 3 shows in more detail a fragment of the embodiment of the foundation pile assembly 1 of FIGS. 1 and 2 at the height of the tip 10. The tip 10 extends, as a whole, axially from the top attachment side 12 to the bottom tip side 14 along the central longitudinal axis L. As shown, this central longitudinal axis L also forms the central longitudinal axis for the cast iron tip body 120 and of the element 110 partially molded-in into the cast iron tip body 120, further also called attachment element. As shown, the tip 10 is therefore formed by an axial succession of the attachment element 110 and the tip body 120. This means that the attachment element 110, which is, for example, tubular, extends axially from the top attachment side 12, along the central longitudinal axis L, up to the cast iron tip body 120, and that subsequently the cast iron tip body 120, which, for example, comprises a cone-shaped part 125, extends axially up to the bottom tip side 14, such that the point 36 of the cone-shaped part 125 is located at the bottom. It is thereby clear that the attachment element 110 partially molded-in into the cast iron tip body 120 extends axially from an external end 112 to a molded-in end 114. The external end 112 is located at the top and forms the attachment side 12 of the tip 10 as is shown. The molded-in end 114 is located as shown, at the bottom of the attachment element 110 and is substantially completely enveloped by the cast iron tip body 120. The element 110 partially molded-in into the cast iron tip body 120 thus comprises a molded-in part 116 which extends in the cast iron tip body 120. As shown, this molded-in part 116 forms the bottom part of the attachment element 110 and this molded-in part 116 is substantially completely enveloped by the cast iron tip body 120. As further on will be explained in more detail, it is clear that this molded-in part 116 is enveloped with this cast iron during the molding process for manufacturing the cast iron tip body 120 since it is enveloped with liquid cast iron of the tip body 120. After the solidification of the cast iron of the tip body 120, a connection between the attachment element 110 and the cast iron tip body 120 is achieved in this manner. As further shown, the attachment element 110 also comprises an external part 118 which extends outside of the cast iron tip body 120. This external part 118 extends axially from the cast iron tip body 120 in the direction of the attachment side 12 of the tip 10 where it is attached to the external end 112 at the bottom end 22 of the steel foundation pile 20. As is further shown the cast iron tip body 120 extends axially from a top end 122 to a bottom end 124. As shown the attachment element 110 thus extends axially out from the top external end 112, past the top end 122 of the cast iron tip body 120, to the bottom molded-in end 114.

In order to partially mold the attachment element 110 into the cast iron tip body 120, it is advantageous that the attachment element 110 consists of a material having a higher melting point than the cast iron of the cast iron tip body 120. It is additionally advantageous if the attachment element 110 consists of a material which can be more easily connected to the bottom end 22 of the foundation pile 20 by means of a welded joint than the cast iron of the cast iron tip body 120. In exemplary embodiments wherein use is made of a steel foundation pile 20, it is therefore advantageous to make use of, for example, a steel attachment element 110. Preferably, the steel type, this means, inter alia, the steel alloy, of the steel foundation pile 20 and the steel attachment element 110 correspond or substantially correspond. This means, for example, that the mass fraction or the mass percentage of carbon or other elements of the steel foundation pile 20 and the steel attachment element 110 are closer to each other than with the corresponding values for the cast iron of the cast iron tip body 120. Preferably, the values for the mass-fraction or mass-percentage for carbon of the steel foundation pile 20 and the steel attachment element 110, correspond substantially. This means that the respective values for the mass fraction or the mass percentage for carbon of the steel foundation pile 20 and the steel attachment element 110 differ up to maximum 10%, for example, up to maximum 5%, preferably up to maximum 3% from each other. Typically, the mass fraction or the mass percentage for carbon of the cast iron tip body 120 will be more than 10%, for example, more than 25%, for example, more than 50% higher than that of the steel foundation pile 20. According to an exemplary embodiment, the mass percentage of carbon of the foundation pile 20 and of the attachment element 110 is for example 0.5% (m/m), and the mass percentage of carbon of the cast iron tip body 120 is for example 3% (m/m). It is thereby clear that both the steel foundation pile 20 and the steel attachment element 110, for example, are tubular and are not manufactured by means of a molding process, but by means of a process for manufacturing a tubular steel profile or structure, for example, manufactured on the basis of a steel sheet which was subjected to rolling operations and welding operations. According to an embodiment, the steel attachment element 110 may be manufactured using a section of a steel tube, similar to the steel tube which is used for manufacturing the steel foundation pile 20.

However, it is clear that alternative embodiments are possible, as long as in general the attachment element 110 is manufactured from a material that can be attached easier and simpler to the steel foundation pile 20 by means of a welded joint. This facilitates the on-site attachment of the tip 10 at the bottom end of the foundation pile 20 at the construction site itself, without the need for providing special welding techniques, apparatuses, etcetera. In general, in the context of this application, cast iron may be considered as a cast alloy of iron comprising a mass percentage of carbon of more than 2.2% (m/m), this means a mass fraction for carbon of more than 0.022 kg/kg, for example a value between 0.0350 kg/kg and 0.0385 kg/kg. In general, in the context of this application, steel, may be considered as an iron alloy comprising a mass percentage of carbon of 2.1% (m/m) or less, this means a mass fraction for carbon of 0.021 kg/kg or less. With nodular iron one usually speaks of a carbon content, for example, a mass fraction of 0.035 kg/kg. In lamellar cast iron one usually speaks of a carbon equivalent, for instance a mass percentage between 3.53% and 3.8%.

According to the shown exemplary embodiment, the transverse cross-section of the foundation pile 20 preferably corresponds to the transverse cross-section of the tip 10 at the height of the bottom end 22 of the foundation pile 20. According to the shown exemplary embodiment, this means that, as further described in more detail, the tube-shaped steel attachment element 110, transverse to the central longitudinal axis L, shows a cross-section that corresponds to the transverse cross-section of the foundation pile 20 at the height of the bottom end 22 of the foundation pile 20. It is clear that the bottom end 22 of the foundation pile 20 and the external end 112 of the attachment element 110 partially molded-in into the cast iron tip body 120 in such an embodiment can be welded together in line with each other. However, it is clear that alternative embodiments are possible, for example, wherein the transverse cross-section is not circular, but comprises a different suitable shape. In further alternative embodiments it is, for example, also possible that the respective transverse cross-sections instead of corresponding to each other, are connected to one another, wherein, for example, at the height of the bottom end 22, the attachment element 110 envelopes the foundation pile 20 or vice versa, such that a connection by means of a welded joint can also be realized. It is clear that, although in the shown exemplary embodiment, the respective transverse cross-sections fully correspond, alternative embodiments are possible wherein the respective transverse cross-sections only partially correspond or connect to each other, as long as the corresponding or connected parts allow for a welded joint.

That both the cast iron tip body 120 as well as the partially molded-in steel attachment element 110 extend axially along the central longitudinal axis L of the steel foundation pile 20 is particularly advantageous to efficiently deal with the axial loads that are exerted to enter the foundation pile assembly 1 into the ground layer 2, as well as the load that, after entering in the ground layer 2, is exerted on the foundation pile assembly 1 by the support structure. In embodiments, such as the shown embodiment, wherein upon entering, the foundation pile assembly 1 is subjected to a screw movement by applying a torque K around the central longitudinal axis L, this is additionally advantageous to uniformly divide the load as uniform as possible as a result of this torque.

Figure 4:
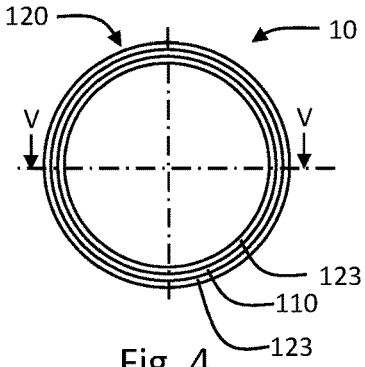
FIG. 4 schematically shows a top view of an embodiment of the tip similar as shown in FIG. 3.
Figure 8:
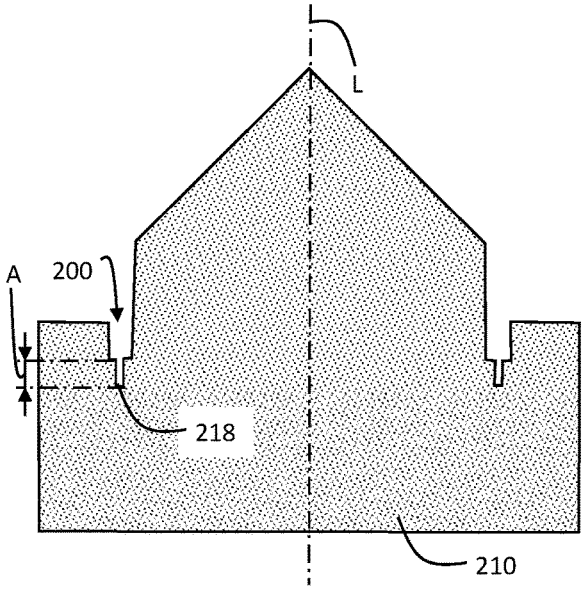
FIGS. 8 to 11 schematically show different steps of an embodiment for manufacturing an embodiment of the tip similar as shown in FIGS. 1 to 7.

FIG. 4 schematically shows a top view of an embodiment of the tip 10 similar as shown in FIG. 3. FIG. 5 schematically shows a cross-section of this embodiment of the tip of FIG. 4, along the line V-V in FIG. 4. As can be seen in FIGS. 4 and 5, the cast iron tip body 120 comprises a cone-shaped part 125 at the bottom and connects to a cylindrical part 123 at the top. According to the shown embodiment, both the cylindrical part 123 as the cone-shaped part 125 are hollow, this means provided with a central axial cavity around which a cast iron casing extends itself. Such a hollow design is advantageous since this limits the amount of cast iron that needs to be applied for manufacturing the cast iron tip body 120. It is clear that alternative embodiments are possible, wherein one or more parts 123, 125 of the cast iron tip body 120 is not, or only partially provided with such a central axial cavity.

As can be seen in FIG. 5, the cone-shaped part 125 is located at the bottom of the cast iron tip body 120, this means at the bottom end 124 and the orientation of the cone-shaped part 125 is, such that the point 36 is also directed toward the bottom end 124. It is clear that the base of this cone-shaped part 125 is directed toward the opposite top end 122 of the cast iron tip body 120. It is further also clear that this cone-shaped part 125 does not need to comprise a perfect cone-shaped casing surface, it is advantageous if the cast iron tip body 120 comprises a substantially cone-shaped part 125 at the bottom, or comprises a similar shape known to the person skilled in the art that facilitates the penetration of the ground layer 2 during entering of the foundation pile assembly 1. As can be seen further, the cylindrical part 123 connects, according to the shown embodiment, to the base of the cone-shaped part 125 and this cylindrical part axially extends further to the top end 122 of the cast iron tip body 120. As can be seen further, according to the shown embodiment, the molded-in part 116 of the tubular steel attachment element 110 is molded-in at the top end 122 in this cylindrical part 123. As shown, the molded-in part 116 of the tubular steel attachment element 110 is substantially completely enveloped by the cast iron of the cast iron tip body 120. This means, as shown, that the cylindrical part 123 of the cast iron tip body 120 extends radially on either side from the tubular attachment element 110. The cylindrical part 123 of the cast iron tip body 120 in this manner forms a hollow cylindrical structure which is coaxial with the tubular attachment element 110 and with an outer wall whose diameter is larger than the diameter of the outer wall of the tubular attachment element 110. The diameter of the inner wall of the cylindrical part 123 of the cast iron tip body 120 is as shown in turn smaller than the diameter of the inner wall of the tubular attachment element 110. The cylindrical part 123 of the cast iron tip body 120 extends according to the shown embodiment axially from the top end 122 of the cast iron tip body 120 until the molded-in end 114 of the attachment element 110, where the cylindrical part 123 connects to and merges into the cone-shaped part 125 of the cast iron tip body 120. The molded-in part 116 of the attachment element 110 extends axially from the molded-in end 114 until the top end 122 of the cast iron tip body 120, where it connects to and merges into the external part 118 that extends outside of the cast iron tip body 120. As can be seen, the external part 118 of the tubular steel attachment element 110 forms a hollow, cylindrical structure which protrudes axially over a determined distance A, with respect to the top end 122, out of the cast iron tip body 120. This distance A is any suitable distance which allows in a simple manner to arrange the external part 118 of the tubular steel attachment element 110 by means of a welded joint to the bottom end 22 of the steel foundation pile 20, for example, 1 cm or more, more in particular 3 cm or more.

As is further shown, the molded-in part 116 of the tubular steel attachment element 110 comprises a plurality of openings 142 which extend radially through the hollow cylindrical steel casing of the molded-in part 116 of the tubular steel attachment element 110. Since the molded-in part 116 in the cast iron tip body 120 is molded-in, the cast iron of the cast iron tip body 120 extends through the radial openings 142 and it thereby fills up these radial openings 142. According to the shown exemplary embodiment, the cylindrical part 123 of the cast iron tip body 120 located radially on either side of the tubular steel attachment element 110, is thus anchored through these openings to the tubular steel attachment element 110. This is, for example, also clearly shown in FIG. 16 which schematically shows a cross-section along the line VB-VB of the indicated fragment from FIG. 5. Such an anchoring of the cast iron tip body 120 to the tubular steel attachment element 110 allows, for example, for the exchange of high forces and/or torques between the attachment element 110 and the tip body 120 to reduce the risk of separation of the tip body 120 from the attachment element 110. It is clear that according to alternative embodiments, the number and the positioning of the openings 142 can vary, as long as one or more openings 142 radially extend through the steel casing of the molded-in part 116 of the tubular steel attachment element 110. According to yet other alternative embodiments, the openings 142 do not need to extend completely through the steel casing of the molded-in part 116, an anchoring may also be realized when the openings only extend partially radially through the casing, this means radially not completely through the casing of the molded-in part 116. Also in this case the cast iron of the cast iron tip body 120 will extend into these openings in order to realize an anchoring. Further it is also clear that, although in the shown exemplary embodiment the radial openings are shown with a circular cross-section, according to alternative embodiments suitable radial openings with another suitable cross-section can be used. It is clear that, according to still further alternative embodiments, instead of openings, one or more suitable recesses, protrusions, etcetera that extend at least partially radially are also able to achieve similar anchorings.

FIGS. 6 and 7 further show two alternative embodiments of a tubular steel attachment element 110 for a tip body 120, similar to that described above. As shown the molded-in part near the molded-in end 114 of the attachment element 110 comprises a plurality of recesses 144 and protrusions 146 which at least partially extend axially. It is clear that these recesses and protrusions, in particular, are advantageous to realize an anchoring between the tip body 120 and the molded-in part 116 of the attachment element 110 which reduces the risk that at the exchange of high torques the tip body 120 and the molded-in part 116 separate from each other. It is thereby clear that the recesses 144 and protrusions 146 axially extend at a determined distance from the central longitudinal axis L, that is to say, eccentrically with respect to the central longitudinal axis L. According to alternative embodiments, instead of recesses or protrusions, one or more openings can also be provided in the molded-in part 116, which extend at least partially axially, eccentrically with respect to the central longitudinal axis L.

It is clear that further alternative embodiments are possible wherein the molded-in part 116 of the attachment element 110 comprises at least partially radial openings 142, recesses or protrusions, as shown, for example, in FIGS. 4 and 5 which are combined with at least partially axially extending recesses 144, protrusions 146, or openings, such as, for example, shown in FIGS. 6 and 7.

According to alternative embodiments not shown, the cast iron tip body 120 can be provided with one or more, not shown, spiral ribs or taps. It is clear that such ribs are configured to possibly support the entering of the foundation pile assembly 1 by means of a screw movement. It is clear that embodiments of such spiral ribs can be carried out, for example, similar to spiral ribs as known to the person skilled in the art as known from, for example, U.S. Pat. No. 4,623,025, EP0855489, WO2011/075772, etcetera. The fact that the tip body 120 is a cast iron tip body 120, thereby allows to manufacture a tip 10 in a simple, flexible and efficient manner, wherein no compromises are necessary with regard to the design of such spiral ribs. It is sufficient to apply the design of the spiral ribs at the manufacturing of the mold for the cast iron tip body 120. Subsequently the cast iron tip body 120, even when these ribs comprise a complex design, time after time, can be manufactured with a simple molding operation, without the need for complex operations, such as cutting operations, welding operations, and the like to manufacture such ribs and/or to arrange to the tip. It is further clear that the ribs and/or the taps thereto are arranged in a known manner to the outer casing and/or to the bottom side of the tip 10.

FIGS. 8 to 11 show different steps of an embodiment of a method for manufacturing a tip 10 similarly as described above. Similar parts of the tip 10 are indicated with similar references and will only be described over again in so far as it is relevant to the method for manufacturing the tip 10. In a step shown in FIG. 8, a lower sand mold 210 for a mold 200 is provided for the cast iron tip body 120. As shown, the mold 200 comprises a recess 218. This recess 218 corresponds to the external part 118 of the attachment element 110. For the exemplary embodiment described above with a tubular steel attachment element 110, this therefore means, as shown a recess 218 which extends as a hollow cylinder, coaxially with the central longitudinal axis L of the mold 200 for the cast iron tip body 120. This recess therefore extends axially over the determined distance A in the mold 200, wherein this determined distance A corresponds to the determined distance A (shown in FIG. 5) at which the external part 118 axially protrudes from the cast iron tip body 120.

Figure 9:
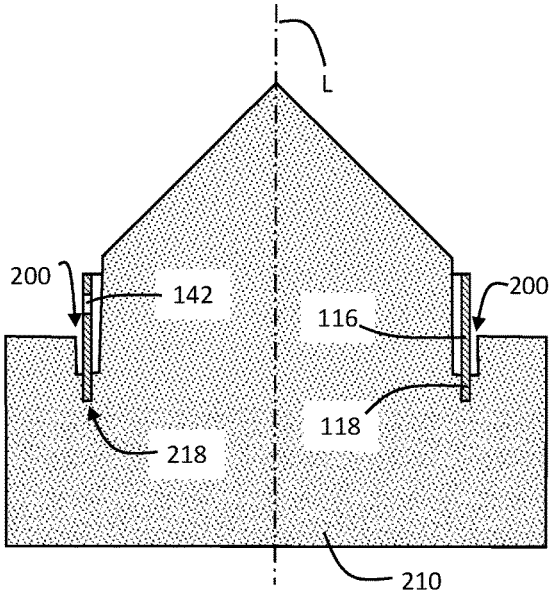

In a next step, as schematically shown in FIG. 9, the external part 118 of the attachment element 110 is arranged in the recess 218. It is clear that the external part 118 of the attachment element 110 is arranged in the recess, such that the molded-in part 116 extends, as shown in the mold 200 of the cast iron tip body 120.

Figure 10:
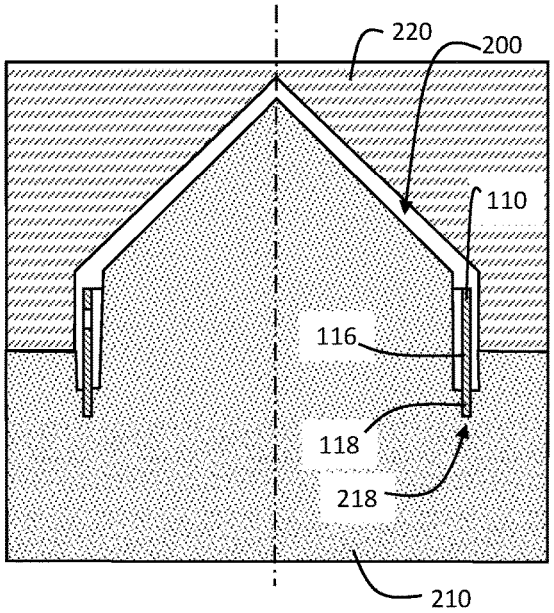
Figure 11:
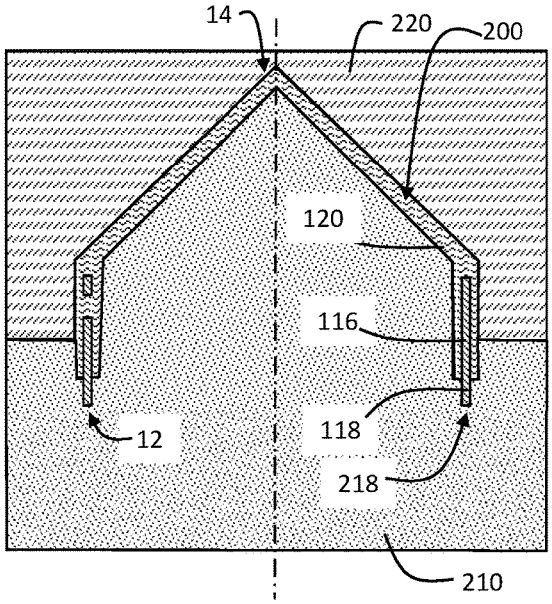

As shown in FIG. 10, the mold 200 for the cast iron tip body 120 is subsequently completed by providing an upper sand mold 220 and subsequently, as shown in FIG. 11, liquid cast iron is molded in the mold 200, such that the molded-in part 116 of the steel attachment element 110 is molded-in.

Although the above method for manufacturing a tip 10 makes use of a lower sand mold 210 and an upper sand mold 220 it is clear that alternative embodiments for the mold 200 are possible, such as, for example, alternative embodiments of sand molding, molding processes which make use of permanent molds, etcetera. It is thereby clear that a correct positioning of the attachment element 110 that is partially molded-in in the cast iron tip body 120 is ensured by the positioning of the external part 118 of the attachment element 110 into the corresponding recess 218 of the mold 200.

Figure 12:
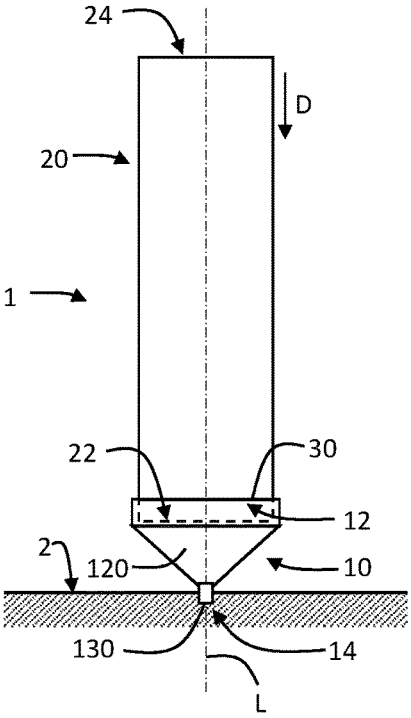
FIG. 12 shows an alternative embodiment of a foundation pile assembly in a similar state as shown in FIG. 1.

FIG. 12 shows an alternative embodiment of a foundation pile assembly 1 in a similar position as shown in FIG. 1, this means for the entering of the foundation pile assembly 1 into the ground layer 2. The shown foundation pile assembly 1 is similar to the embodiments described above and similar elements are indicated with a similar reference and will only be repeated here in order to indicate the differences. As shown the foundation pile assembly 1 also comprises a foundation pile 20 axially extending along a central longitudinal axis L with a tip 10 at its bottom end 22. The tip 10 also comprises an element 130 partially molded-in into the cast iron tip body 120, further also called tip element, however this partially molded-in element 130 is now located at the tip side 14 of the tip 10.

Figure 14:
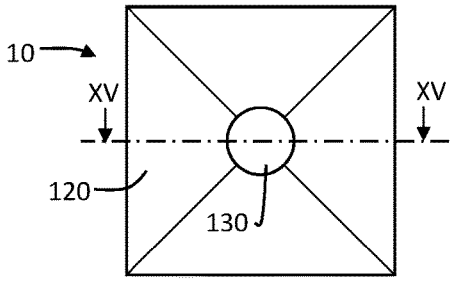
FIG. 14 schematically shows a bottom view of the tip of the foundation pile assembly of FIG. 12.
Figure 13:
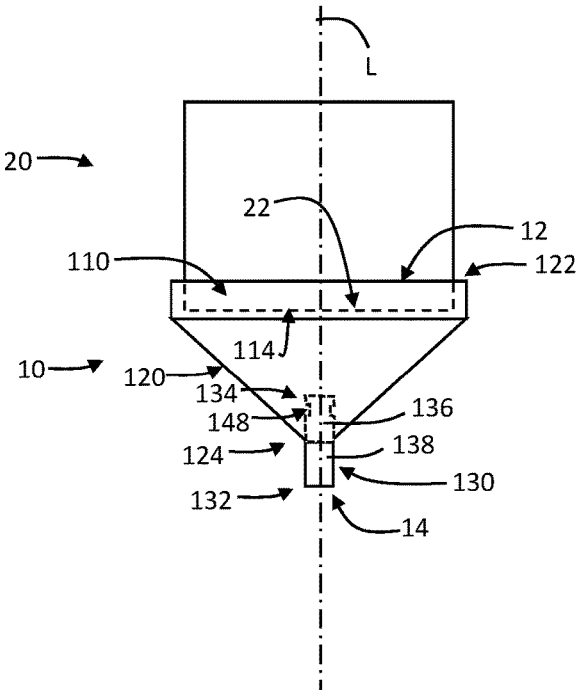
FIG. 13 schematically shows a fragment similar to FIG. 3 of the embodiment of FIG. 12.

As is shown in more detail in FIG. 13, the element 130 partially molded-in into the cast iron tip body 120 at the tip side 14 of the tip 10 is arranged as a tip element 130 for the foundation pile 20. For example, according to an embodiment, the foundation pile 20 can be designed as a pre-manufactured steel or concrete foundation pile, at which the tip 10 is arranged at its bottom end 22. As can be seen, the shown embodiment of the tip 10 comprises at its attachment side 12 a cast iron tip body 120 which connects to the bottom end 22 of the foundation pile 20, and as it were forms a foot or support surface for the foundation pile 20. The tip 10 can, for example, be anchored to the foundation pile 20 in a mechanical manner. At the bottom end 22 the tip element 130 is partially molded-in in this cast iron tip body 120. It is clear that the tip element 130 has a transverse cross-section which is smaller than the transverse cross-section of the foundation pile 20. It is known to the person skilled in the art that such a tip element 130 is advantageous during the entering of the foundation pile assembly 1, but especially to provide a reliable supporting point in a rocky soil, such as known from FI85901B. As shown, both the foundation pile 20, the cast iron tip body 120 and the tip element 130 are preferably arranged coaxially. As can be seen in the bottom view of FIG. 14, the cast iron tip body 120 of the tip 10, as well as the foundation pile 20 both comprise a rather square or rectangular transverse cross-section and the foundation pile 20 is therefore rather beam-shaped. As shown the cast iron tip body is rather pyramidal here, wherein the point of the pyramid shape is directed downward, and the partially molded-in tip element 130 rather corresponds to a full cylindrical shape. It is clear that such a foundation pile assembly 1 during entering into the ground layer will, for example, only be subjected to a pressure force D, and will not be exposed to a torque around the central longitudinal axis L. However, it is clear that variant embodiments are possible, for example, wherein the foundation pile 20 is tubular and wherein the tip 10 also comprises a suitable form to allow for a screw movement around the central longitudinal axis L as a result of a torque.

Similarly as described above with respect to the attachment element 110, the tip element 130 also comprises a molded-in part 136 and an external part 138. The molded-in part 136 is, as shown substantially completely enveloped by the cast iron of the cast iron tip body 120. The external part 138 extends outside of the cast iron tip body 120. However, this time the external part 138 extends axially at the tip side 14 of the tip 10. As shown, the molded-in part 136 of the tip element 130 comprises a recess 148 which extends partially radially into the molded-in part 136. Similarly as described above this recess 148 ensures for an improved anchoring of the tip element 130 in the cast iron tip body 120 to be able to withstand high axial pressure forces D with a reduced risk that the tip element 130 separates from the tip body 120. It is thereby clear that the tip element 130 partially molded-in into the cast iron tip body 120 extends axially from an external end 132 to a molded-in end 134. Furthermore, it is clear that, the in the ground layer 2 entered state, when the tip-element 130 forms the supporting point for the foundation pile assembly 1, because the molded-in part 136 of the tip element 130 is substantially completely enveloped by the cast iron of the cast iron tip body 120, the tensions can be distributed very uniformly from the tip element 130, through the cast iron tip body 120 until the bottom end 22 of the foundation pile 20, such that local peak loads are reduced. This is possible since, due to the partial molded-in of the tip element 130 in the cast iron tip body 120, no recess and associated tolerance must be provided in the tip body 120 to be able to arrange the tip element 130 afterwards. It is clear that the tip element 130, for example, can be manufactured from steel.

It is further also clear that, similarly as described above, this embodiment of the tip 10 can be manufactured according to a method wherein a mold 200 is provided for the cast iron tip body 120 with a recess corresponding to the external part 138 of the tip element 130, after which this external part 138 is arranged in the recess of the mold, such that the molded-in part 136 extends in the mold 200 for the cast iron tip body 120. Subsequently, liquid cast iron is then molded in the mold 200, such that the cast iron tip body 120 is formed, wherein the molded-in part 136 of the tip element 130 is molded-in. This allows to manufacture such a tip 10 in a simple manner without the need for separate operations or fixing elements for the arrangement of the tip element 130 in the cast iron tip body 120.

Figure 15:
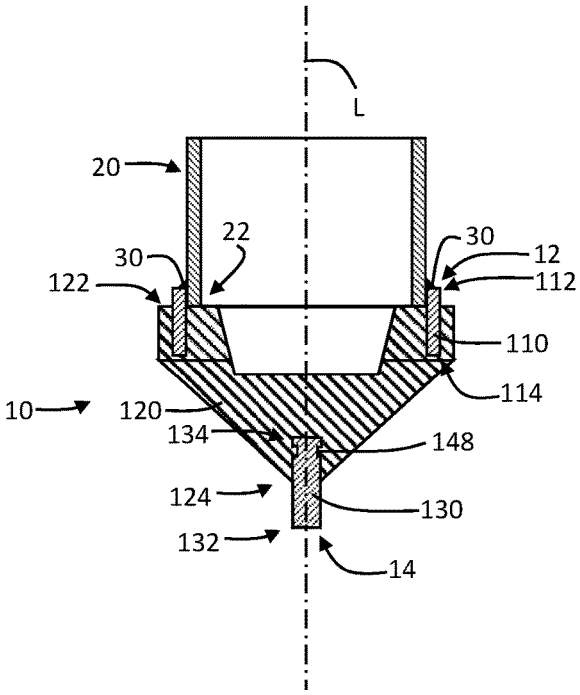
FIG. 15 shows a partial section view along the line XV-XV in FIG. 14 of an alternative embodiment of the foundation pile assembly of FIG. 13, with a similar bottom view as shown in FIG. 14.

According to an alternative, shown in FIG. 15, a tip body 120 according to the invention can be provided with several elements partially molded-in in the cast iron tip body 120, for example, both with an attachment element 110 and with a tip element 130. The shown embodiment is similar to the embodiment shown in FIGS. 13 and 14. Similar elements are shown with similar references and function in general similarly as described above. The bottom view of this embodiment is identical to, for example, the bottom view shown in FIG. 14. FIG. 15 shows a partial cross-section along the line XV-XV in FIG. 14 of this alternative embodiment. Similarly as in the embodiment shown in FIG. 13, the tip 10 comprises at its tip side 14 an element 130 partially molded-in into the tip body 120. This alternative embodiment comprises, at the attachment side 12 of the tip 10, an element 110 partially molded-in into the tip body 120, for example, a steel attachment element 110 for the attachment of a steel foundation pile 20. According to the exemplary embodiment shown in FIG. 15, the attachment element 110 is hereby attached to a casing surface of the foundation pile 20 by means of a welded joint 30. It is clear that the casing surface of the foundation pile 20 connects at least partially to the inner surface of the attachment element 110 at the height of the welded joint 30. The foundation pile 20 is as it were, at the height of its bottom end 22 partially slid into the attachment element 110. It is clear that a number of variant embodiments, similar to the embodiment shown in FIG. 15, are possible. For example, it is possible that, instead of a foundation pile 20 with a square or rectangular cross-section and an associated attachment element 110 with a square or rectangular cross-section, similar as in the described embodiment with respect to FIGS. 4 and 5, the foundation pile 20 and the associated attachment element 110, for example, comprise a circular cross-section. Furthermore it is also clear that according to alternative embodiments, the foundation pile 20 and the attachment element 110 may have a corresponding cross-section that allows by means of a welded joint 30 to be connected in line, likewise similarly as described in the embodiments shown in FIGS. 1 to 3.

It is clear that numerous variant embodiments are possible without departing from the scope of protection of the invention as defined in the claims.

The invention claimed is:

1. A tip for attachment to a bottom end of a foundation pile, the tip comprising a tip body formed from cast iron and an element partially molded-in into the tip body, the partially molded-in element comprising:

a molded-in part extending into the tip body and enveloped by the cast iron of the tip body; and an external part extending outside the tip body;

wherein the element partially molded-in into the tip body defines:

at least one opening extending at least partially radially relative to a central longitudinal axis; and at least one recess and/or protrusion extending at least partially axially relative to the central longitudinal axis.

2. A tip according to claim 1, wherein:

the tip extends axially from a top attachment side for the attachment of the foundation pile to an opposite bottom tip side along the central longitudinal axis;

the tip body also extends axially along the central longitudinal axis of the tip, from a top end to a bottom end; and the element partially molded-in into the tip body also extends axially along the central longitudinal axis of the tip, from an external end toward a molded-in end.

3. A tip according to claim 1, wherein the element partially molded-in into the tip body consists of a material having a higher melting point than the cast iron of the tip body.

4. A tip according to claim 1, wherein the tip is configured for attachment to a steel foundation pile by means of a welded joint, wherein the element partially molded-in into the tip body is a steel attachment element arranged at an attachment side of the tip.

5. A tip according to claim 4, wherein the steel attachment element is tubular.

6. A tip according to claim 5, wherein the tip body:

comprises a cylindrical part at a top end, wherein the molded-in part of the tubular steel attachment element is molded-in; and/or comprises a cone-shaped part, of which a point is located at the bottom end.

7. A tip according to claim 1, wherein the cast iron tip body comprises one or more spiral ribs.

8. A tip according to claim 1, wherein the element partially molded-in into the tip body is arranged at a tip side of the tip as a tip element for the foundation pile.

9. A tip for attachment to a bottom end of a foundation pile, the tip comprising a tip body formed from cast iron and an element partially molded-in into the tip body, the element partially molded-in into the tip body comprising:

a molded-in part extending into the tip body and enveloped by the cast iron of the tip body; and an external part extending outside the tip body;

wherein the element partially molded-in into the tip body defines at least one of:

at least one opening, protrusion and/or a recess extending at least partially radially relative to a central longitudinal axis; and/or at least one opening, protrusion and/or recess extending at least partially axially relative to the central longitudinal axis;

wherein the tip body comprises one or more spiral ribs.

10. A tip according to claim 9, wherein:

the tip extends axially from a top attachment side for the attachment of the foundation pile to an opposite bottom tip side along the central longitudinal axis;

the tip body also extends axially along the central longitudinal axis of the tip, from a top end to a bottom end; and the element partially molded-in into the tip body also extends axially along the central longitudinal axis of the tip, from an external end toward a molded-in end.

11. A tip according to claim 9, wherein the element partially molded-in into the tip body consists of a material having a higher melting point than the cast iron of the tip body.

12. A tip according to claim 9, wherein the tip is configured for attachment to a steel foundation pile by means of a welded joint, wherein the element partially molded-in into the tip body is a steel attachment element arranged at an attachment side of the tip.

13. A tip according to claim 12, wherein the steel attachment element is tubular.

14. A tip according to claim 13, wherein the tip body:

comprises a cylindrical part at a top end, wherein the molded-in part of the tubular steel attachment element is molded-in; and/or comprises a cone-shaped part, of which a point is located at the bottom end.

15. A tip according to claim 9, wherein the element partially molded-in into the tip body is arranged at a tip side of the tip as a tip element for the foundation pile.

16. A foundation pile assembly comprising a tip according to claim 9, wherein the foundation pile assembly further comprises a foundation pile, and wherein the tip is attached to a bottom end of the foundation pile.

17. A foundation pile assembly according to claim 16, wherein at a height of the bottom end, a transverse cross-section of the foundation pile at least partially connects to or corresponds to a cross-section of the tip.

18. A foundation pile assembly according to claim 16, wherein the tip is attached to the foundation pile by means of a welded joint.

19. A method for manufacturing a tip according to claim 9, wherein the method comprises the steps of:

providing a mold for the tip body comprising a recess corresponding to the external part of the element;

arranging the external part of the element in the recess of the mold, so that the molded-in part extends into the mold for the tip body; and subsequently, molding liquid cast iron into the mold for the tip body, so that the molded-in part of the element is molded-in.

20. A method for manufacturing a tip according to claim 19, wherein the method comprises the steps of:

providing a lower sand mold for the mold, the lower sand mold comprising the recess, subsequently arranging the external part of the element in the recess;

subsequently completing the mold by providing an upper sand mold; and subsequently molding liquid cast iron into the mold, so that the molded-in part of the element is molded-in.

* * * * *